US005692625A

United States Patent [19]

Filipescu et al.

[11] Patent Number: 5,692,625

[45] Date of Patent: Dec. 2, 1997

[54] FOLDING TRANSPORTATION RACK AND PRODUCT DELIVERY SYSTEM

[75] Inventors: Florin Filipescu, Toledo; Ronald C. Abbott, Sandusky, both of Ohio; Eugene A. Brockhaus, Farmington Hills, Mich.

[73] Assignee: Sandusky Limited, Sandusky, Ohio

[21] Appl. No.: 466,794

[22] Filed: Jun. 6, 1995

[51] Int. Cl.[6] ..... A47B 43/00

[52] U.S. Cl. ..... 211/195; 211/13; 211/194; 242/594.6; 242/598.3

[58] Field of Search ..... 242/598.3, 598.4, 242/594.6; 211/13, 194, 195, 182, 191

[56] References Cited

U.S. PATENT DOCUMENTS

| | | | |
|---|---|---|---|
| 1,569,358 | 1/1926 | Cross | 211/182 |
| 1,638,236 | 8/1927 | Best | 242/594.6 X |
| 1,801,993 | 4/1931 | Beckwith | 211/182 X |
| 2,955,715 | 10/1960 | Carlson | 211/182 X |
| 2,956,763 | 10/1960 | D'Arca | 211/195 X |
| 3,084,803 | 4/1963 | Bayers . | |
| 3,152,670 | 10/1964 | Selkregg, Jr. et al. | 211/182 X |
| 3,355,029 | 11/1967 | Eurey . | |
| 3,430,773 | 3/1969 | Hancock . | |
| 5,169,011 | 12/1992 | Ebeling et al. | 211/195 |
| 5,228,821 | 7/1993 | Gleffe et al. . | |
| 5,242,255 | 9/1993 | Gleffe et al. . | |

*Primary Examiner*—Blair Johnson
*Attorney, Agent, or Firm*—Marshall & Melhorn

[57] ABSTRACT

This invention relates to a rack for transporting, storing and dispensing bales of manufactured rolled goods. The folding transportation rack and product delivery system prevents damage to the bales during transportation and permits removal of the product from the bale directly from the rack. The rack is collapsible and includes a base with end frames pivotally attached to the base. Side support members are attached to the end frames when the end frames are in an extended position. Cam fixtures are aligned on either of the opposing frames or an opposing side support members to vertically secure both long core and short core bales of rolled goods. The racks are interchangeable and allow the stacking of several racks while holding bales of material. The present invention also permits the dispensing of the material directly from the storage rack. Upon removal of all the rolled goods from the bale, the entire rack collapses into a smaller structure and may be stacked onto other racks for return shipping and reuse.

8 Claims, 4 Drawing Sheets

FOLDING TRANSPORTATION RACK AND PRODUCT DELIVERY SYSTEM

BACKGROUND OF THE INVENTION

1. Field of the Invention

This invention relates to an apparatus for transporting, storing, and dispensing bales of rolled manufactured goods. More particularly, this invention relates to a folding transportation rack and product delivery system that prevents damage to the rolled goods on the bale during transportation and permits removal of the product from the bale directly from the rack.

2. Summary of Related Art

Rolled goods are typically wound onto a cylindrical core to form a bale. The bales are then placed onto a flat pallet for subsequent storage and transportation until utilized for further processing. Storage of the material on the pallet requires that the finished product be in direct contact with the surface of the pallet.

The bales are removed from the pallet prior to the final processing step. The storage on the flat pallet can deform the rolled goods and create flat spots in the cylindrical bale. These flat spots are often the source of quality issues that arise while the rolled goods are in the final processing step.

Additionally, the use of flat pallets can cause breakage and tearing of the rolled goods on the bale as the bale rests on the pallet during the handling associated with storage and transportation. The rolled goods are also subject to breakage and tearing while being removed from the pallet for final processing.

U.S. Pat. No. 5,228,821 issued to Gleffe et. al. discloses a re-usable transport and packaging device for storing rolls of sheet product. The apparatus is folded and stacked when not in use. The apparatus includes a rectangular base frame upon which vertical support members are attached. The vertical support members are connected to the base with hinges that allow the vertical support members to pivot downward onto the stabilizing rails of the base frame. The vertical support members also have hinges at their respective mid-points to create an additional folding point.

Gleffe utilizes transverse struts to create mounting members for holding elements. The holding elements are v-shaped blocks that allow for the stationary support of the cylindrical roll during storage and transportation. Stabilizing rails are utilized as longitudinal supports for the upper edges of the vertical support members. The device provides for the longitudinal storage of a single cylindrical roll.

U.S. Pat. No. 5,242,255 issued to Gleffe et. al. discloses a re-usable transport and packaging device for manufactured goods. The device is a folding rack system for holding cylindrical rolls. When not in use, the racks are folded and stacked for storage and transportation. The rack consists of a rectangular base frame with vertical supporting elements connected with hinges at the base frame. The vertical supporting elements are offset on each side to allow the elements to collapse along the longitudinal sides of the base frame without interfering with the elements on the opposing side.

The vertical support elements on each side are connected by a cross frame. The cross frames support V-shaped holding elements. The holding elements provide for the stationary mounting of cylindrical rolls.

It would be advantageous to provide an apparatus to store bales of rolled goods that improves overall product quality by preventing damage to the bale during transportation and storage. The apparatus should allow for various storage arrays for both long and short core bales.

A further advantage would be to provide an apparatus that allows for the removal of the rolled goods directly from the bale while the bale is still positioned in the apparatus.

It would also be an advantage to provide a rack that reduces shipping and storage space requirements by stacking onto each other in both the extended and folded positions.

SUMMARY OF THE INVENTION

In accordance with the present invention, there is provided a collapsible storage rack suitable for storing and dispensing bales of round manufactured goods. Opposing end bars extend between the side bars to complete the rectangular base. The folding rack of the present invention has a generally rectangular base formed by a pair of side bars in parallel, spaced apart relationship. The opposing end bars define opposing ends of the base. The base additionally includes a plurality of legs extending perpendicular from the base and integrally attached to the base.

End frames are positioned at each of the opposing ends of the base. Each end frame has a pair of support stanchions with a lateral cross brace extending between the stanchions. The end frame is pivotally mounted on the base such that the end frame moves from an extended position perpendicular to the base to a collapse position adjacent to the base.

There are side support members removeably mounted onto the support stanchions on opposing ends of the base when the end frames are in the extended position. The side support members are removed and stored adjacent to the base when the end frames are in the collapsed position.

There are at least two cam fixtures mounted onto the rack for vertically securing opposing ends of an inner core of a bale of rolled goods. Cam fixtures are aligned and mounted onto the end frames such that a bale of rolled goods is suspended in an area defined by the end frames and the side support members. The cam fixtures facilitate the removal of the rolled goods directly from the bale while the bale is held in the rack.

The present invention eliminates the use of flat pallets for the storage and transportation of the bales of manufactured goods. The present invention also permits the dispensing of the rolled goods directly from the storage rack. Upon removal of all the material from the bale, the entire rack collapses into a smaller structure which may be stacked onto other racks for returning the racks to the sheet material manufacturer for repeated use.

It is an object of the present invention to provide a storage rack for bales of rolled manufactured goods that maintains the product integrity by preventing damage to the material during transportation and storage. The present invention supports the bales at each end of the core and thereby prevents the rolled goods from coming in contact with anything during storage and transportation.

A further object of the resent invention is to provide a storage apparatus that is capable of holding both long core and short core bales of rolled manufactured goods. The present invention provides a structure suitable for holding a large single bale along the longitudinal axis of the rack or two short bales along the transverse axis of the rack.

It is also an object of the present invention to dispense the rolled goods directly from the bale while it is positioned in the rack. This eliminates the potential for further damage to the bale by eliminating an additional handling step. Removal of the material directly from the storage rack also eliminates handling or processing equipment required by the end user during the final processing of the material.

A still further object of the invention is to provide storage racks that reduce shipping and storage space requirements by stacking onto each other in both the extended and collapsed positions. The racks may be stacked two high in the extended array during shipping and up to four high during storage. In the collapsed position, several racks may be stacked onto each other to allow shipping of the racks back to the sheet manufacturer for further use.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
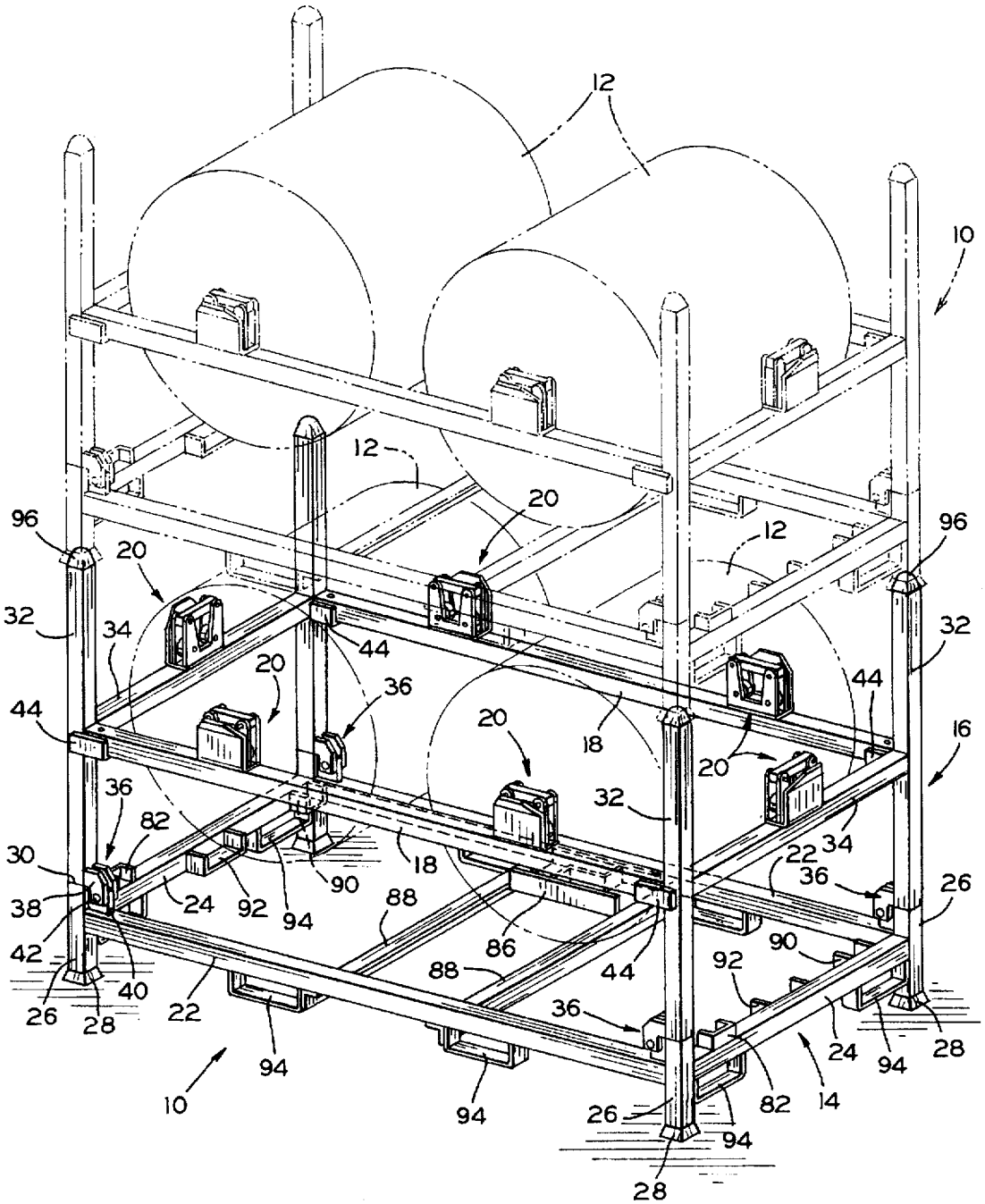
FIG. 1 is a perspective of a rack in the extended position while indicating the support of two transverse mounted bales in phantom. A second rack with bales is illustrated in phantom to show the stacking of the racks in the extended position.

Referring now more particularly to the drawings, there is illustrated in FIGS. 1–7 a collapsible storage rack 10 suitable for storing and dispensing bales of rolled manufactured goods 12. The collapsible rack 10 comprises a base 14 having end frames 16 pivotally attached to the base 14. Side support members 18 are attached to the end frames 16 to secure the end frames 16 in an extended position. Cam fixtures 20 are aligned on either the opposing end frames 16 or on opposing side support members 18 to rotatably secure both long core and short core bales of rolled goods.

In the configuration shown in FIG. 1, two short core bales 12 are mounted between opposing cams 20 on the side support members. A single long core bale (not shown) can be mounted between the cams 20 on the end frames 16.

A generally rectangular base 14 is formed from a pair of parallel side bars 22 and opposing end bars 24, as indicated in FIGS. 1–4. The side bars 22 of the base are positioned in a spaced apart relationship. End bars 24 extend between the side bars 2 to define opposing ends of the base 14. A plurality of vertical legs 26 extend perpendicularly from the base. The side bars 22, end bars 24, and the legs 26 are integrally attached to form a rigid base 14.

Figure 2:
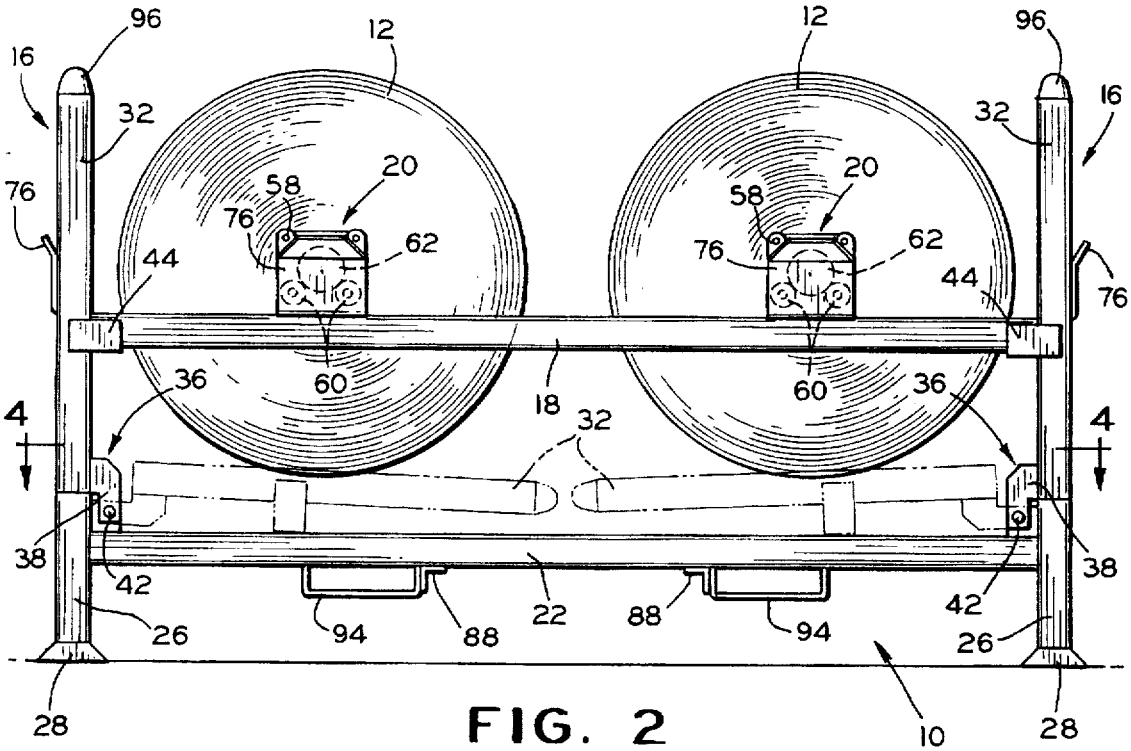
FIG. 2 is a front elevational view of the storage rack supporting two bales with the end frames in the collapsed position indicated in phantom.
Figure 3:
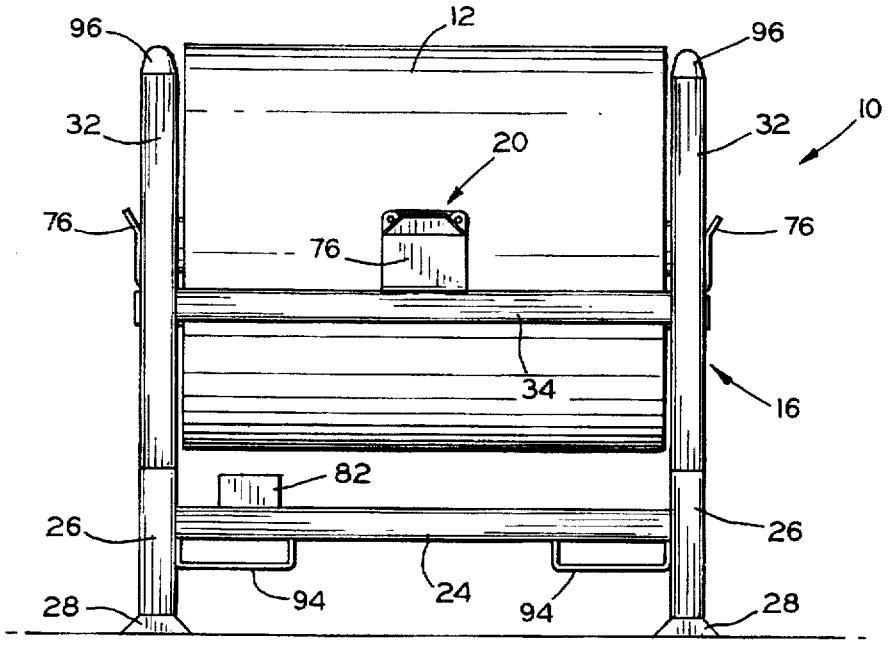
FIG. 3 is a side elevational view of the storage rack in the extended position.

The vertical legs 26 support the base as illustrated in FIGS. 1–3. An expanded footer 28 is at the lower end of each leg 26. The expanded footer 28 provides a sturdy support or foundation for the base. The footer 26 includes a hollow core with an aperture on the bottom to facilitate stacking of the racks 10. The upper end 30 of the leg 26 is a flat surface to support the end frames 16.

End frames 16, shown in FIGS. 1–3, are positioned at opposing ends of the base 14. Each end frame 16 has a pair of support stanchions 32 with a lateral cross brace 34 extending between the pair of stanchions 32. The cross braces 34 on the opposing sides reside in the same horizontal plane.

The end frames 16 are pivotally attached to the base by hinges 36. The hinges 36 are fixed at the lower end of the stanchions 32 and on either the side bars 22 or the end bars 24 of the base 14. The hinged connections 36 provide a pivot point on the base 14 which allows the movement of the end frame 16 from an extended position perpendicular to the base 14 into a collapsed position adjacent to the base 14.

In the present invention, the hinge 36 is generally constructed of a rigid metal material having separate stationary sections fixed to the respective stanchion 32 and side bar 22 of the base 14. The hinges depicted in FIGS. 1 and 2 have two stationary sections 38 positioned on the stanchions 32 in a spaced apart relationship. A single stationary section 40 attached to the base 14 extends between the two sections 38 of the stanchion. The solid sections each have apertures through which a solid hinge pin 42 is fixed. The hinge pin 42 provides the rotational axis for the pivoting of the end frames 16 to either the extended position or the collapsed position. Other hinge structures that allow the pivoting of the end frame into either of the noted positions are suitable for use with the present invention.

In the extended position, the stanchions 32 on each end frame 16 are positioned over the upper end 30 of the vertical legs 26, as shown in FIGS. 1–3. The upper end 30 of the legs 26 support the lower end of each stanchion 32 such that in the extended position, the longitudinal axis of the stanchion 32 and the corresponding leg 26 are aligned vertically. This vertical alignment creates the vertical framework for the rack 10.

Each end frame 16 pivots inward and downward adjacent to the base 14 in a collapsed position. The end frames 16 are indicted in phantom in the collapsed position in FIG. 2. The lower end of the stanchion 32 rotates away from the upper end 30 of legs 26 and thereby exposes the top 30 of the legs 26.

Side support members 18, shown in FIGS. 1–2, are utilized to secure the end frames 16 in the extended positions for the storage of the bales 12. The side support members 18 are longitudinal square bars which extend between opposing end frames 16 along a longitudinal side of the rectangular base 14. The side support members 18 are removeably connected to the stanchions 32 on opposing end frames 16. The side support members 18 provide stability to the rack in the extended position by maintaining the end frames 16 in the vertical position. The side support members 18 also provide a closed framework along the longitudinal sides of the base 14. The framework encloses the internal area surrounded by both end frames 16 and the side support members 18.

The side support members 18 are removeably mounted to the stanchions 32 above the base in mounting tracks 44. The tracks, shown in FIG. 6, each have a horizontal bottom 46 with integrally formed sides 48 extending vertically from the bottom 46. One end 50 of the mounting track 44 is integrally attached to the stanchion 32. The other open end extends toward the opposing stanchion and allows insertion of the side support member 18. The bottom surfaces 46 of all the mounting tracks 44 are in the same horizontal plane so that the side support members 18 are level from end to end and level with respect to each other.

The positioning of the side support members 18 in the mounting tracks 44 is facilitated by a vertically extending dowel 52 fixed within each of the mounting tracks 44. The dowel 52 serves as a guide to align the side support member 18 in the mounting track 44 and prevent subsequent shifting and movement. The dowel 52 is made of mild carbon steel or similar material, and is integrally attached to the upper surface of the horizontal bottom 52. The side support members 18 have apertures 54 through which the dowel 52 extends.

Cam fixtures 20 are utilized to rotatably secure bales 12 of rolled manufactured goods in place within the framework of the rack 10. Each rack 10 has at least two cam fixtures 20 aligned on opposing sides of the rack 10. The fixtures 20 may be placed on the cross braces of each end frame 16 for supporting a long core bale, or the cam fixtures may be placed on opposing side support members 18 for storing two short core bales.

Figure 5:
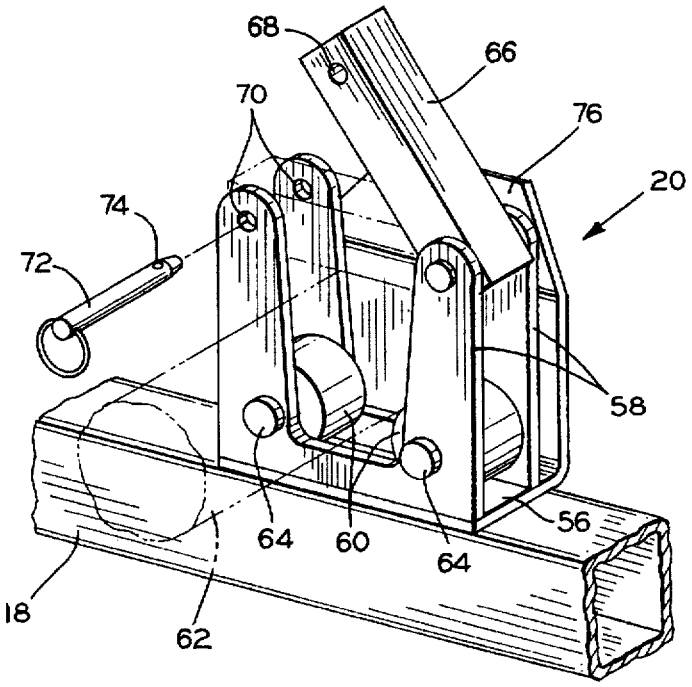
FIG.5 is a perspective of the cam fixture with the core end shown in phantom.
Figure 6:
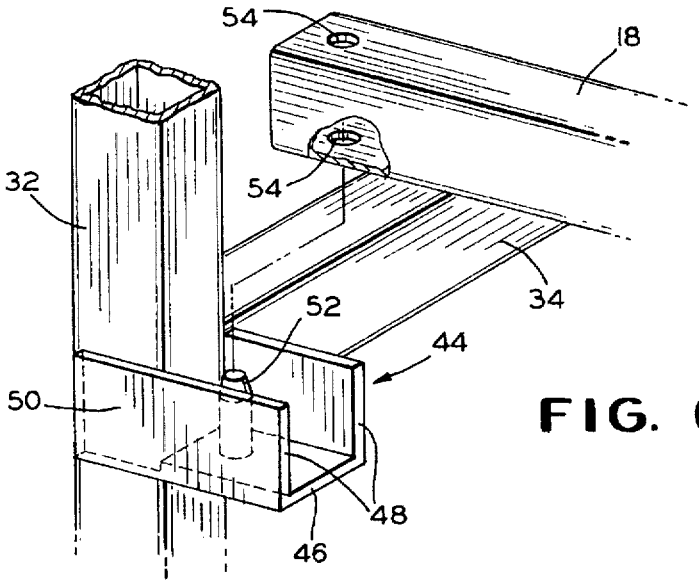
FIG.6 is a broken sectional view of a mounting track on a support stanchion used for securing the side support member in place while the rack is in the extended position.

Each cam fixture 20, illustrated in FIG. 5, generally comprises a base 56, side plates 58, and a pair of cams 60 mounted between the side plates. The side plates 58 are attached to opposing edges of the base 56 and extend vertically upward from the base 56 in a spaced apart relationship. Each of the side plates 58 has a U-shaped channel opening. The channel on each side plate 58 is aligned with the channel on the opposing side plate 58.

Two cams 60 are positioned between the side plates 58 to support a core end 62 from the bale 12 of rolled goods. A portion of each cam 60 extends into the opening created by the channel. The cams 60 are spaced apart such that the core end 62 of the bale 12 will rest evenly on each cam 60. A shaft 64, extending through the side plate 58, serves as the axis of rotation for each cam 60. Each cam 60 has a hardened steel surface for a contact area.

A locking arm 66 is utilized to secure the core end 62 of the bale 12 within the cam fixture 20. The locking arm 66 is pivotally attached to one side of the side plates 58. The locking arm 66 is a bar that extends across the open end of the channel. The opposite end of the locking arm 66 has an aperture 68 which is aligned with corresponding apertures 70 in the side walls 58. A pin 72 may be used in conjunction with apertures 68,70 in the locking arm 66 and in the side plates 58 to hold the locking arm 66 in place. The pin 72 has a compression ball 74 at one end that keeps the pin 72 in place.

The cam fixtures 20 also utilize a guide plate 76 to assist in placing the core end 62 into the cam fixture and to prevent lateral shifting of the core during subsequent transportation. The guide plate 76 extends perpendicular from the base 56 on the outside of each cam fixture 20. The guide plate 76 is spaced away from the outer side plate 58 in a parallel manner. The guide plate 76 is slightly tapered outward at the upper end in order to assist in positioning the core end 62 of the bale 12 into the cam fixtures 20.

The racks support bales 12 of rolled manufactured goods. The intended material is supported or unsupported vinyl. However, other forms of rolled goods are suitable for use with the present invention. With vinyl rolled goods, the sheet thickness ranges from 20–150 mils and is wound onto a cardboard core. The cardboard core acts as a sleeve which partially covers a hollowed hardened steel core. Each opposing end 62 of the steel core is exposed beyond the cardboard. The exposed steel core sections 62 ride on the cams 60 of the cam fixtures 20 of the present invention.

When the rack 10 is reconfigured into the collapsed position (FIG. 4), the rack 10 includes holding units for securing both the long 78 and short 80 cores and the side members 18. The holding units are made with carbon steel plate and are fixed to the base 14.

The holding unit for the long core 78 is provided by a pair of U-shaped brackets 82 having side walls and an end wall. The brackets 82 are aligned at one end of the end bars 24. The long core 78 rests within the brackets 82 and is prevented from shifting by the end walls and the side walls of the bracket 82.

The short cores 80 are attached to the holding units along one of the longitudinal side bars 22. The holding unit for the short cores 80 is a base plate 84 having side wall partitions 86 for each respective short core 80. Angle irons 88 extend transversely across the base 14 to provide support for the base plate 84 of the short core holding unit. U-shaped brackets 90 are positioned internally on end bars 24 of the base 14. The U-shaped bracket 90 and the partitions 86 on the base plate 84 for one short core 80 are off-set from the U-shaped frame 90 and partitions 86 of a second core 80 to accommodate the length of the cores 80. The bottom and side walls of the U-shaped bracket 90 cradle the end of the core 80 and support it within the rack 10.

The removable side members 18 also have holding unit in the rack 10 for carrying the members 18 when the rack 10 is in the collapsed position. The holding units for the side members 18 are centrally located and aligned on the base 14 and are positioned internally on the end frame 24. U-shaped holding brackets 92 are integrally attached to the inside of the opposing end frames 24. The side members 18 are cradled in the holding brackets 92 and supported from underneath by the angle iron cross members 88.

The materials of construction for the rack 10 comprise mainly carbon steel parts and members. The base 14, end frames 16, and side support members 18, and legs 26 are square frame members. The square frame members are generally 2.5"×2.5" box frame constructed with 7 gauge carbon steel. The holding units on the base are constructed of 7 gauge carbon steel plate. Other substantially rigid metals or metal alloys are generally suitable for application with the present invention.

Having set forth a description of the structure of the present invention, the use and function of the storage rack 10 may now be described with particular reference to FIGS. 1–7.

The rack 10 is first set up in the extended position to support either a long core 78 or two short core 80 bales of rolled goods. In the extended position, each end frame 16 is pivoted upward, perpendicular to the base 14, as shown in FIGS. 1–3. The side support members 18 are then inserted into the mounting tracks 44 on the stanchions 32. A side support member 18 is inserted along each longitudinal side. The apertures 54 on the side support members 18 fit over the dowels 52 on the mounting tracks 44 to hold the side support member 18 in place.

The rack is designed to support either a single long core 78 bale of rolled goods or at least one short core 80 bale of rolled goods 12. Most preferably, two short core bales 12 are situated transversely across the rack as indicated in FIGS. 1–3. With the long core bale, the opposing ends 62 of the metal core rest on the cams 60 in the cam fixtures 20. The cam fixtures 20 are aligned and mounted onto the cross braces 34 of the end frames 16. With two short core bales, two cam fixtures 60 are mounted on each side support member 18. Each cam fixtures 20 on the side support member 18 is aligned with a corresponding cam fixture 20 on the opposing side support member 18. This alignment supports two short core bales 12 within the rack 10.

The bales 12 are loaded into the rack 10 with the ends 62 of the core positioned within the cam fixture 20. A lifting hoist (not shown) may be used to lower the bales 12 of finished sheet material into the rack 10. The guide plates 76 on the cam fixtures 20 assist in positioning the core ends 62 of the bale 12 onto the cams 60 of the cam fixture 20. The bale 12 is lowered until the ends 62 of the metal core rests entirely upon the two cams 60 in each cam fixture 20.

The bales 12 are fully supported in the rack 10 by the metal core 80. The cams 60 are mounted and aligned horizontally within the fixture 20 to evenly hold the bale core 12. The rolled goods on the bale 12 do not come in contact with the structure of the rack 10. The material is completely suspended, and thereby protected within the framework of the rack.

After the bales 12 are loaded in the rack 10, the cam fixtures 20 retain the bales 12 within the rack 10 during transportation. The locking arm 68 is lowered over the core end 62 across the top of the channel and fastened to the side plates 58 on the other side of the channel. The locking pin 72 is inserted through apertures 68, 70 of the locking arm 66 and the side plates 58 to secure the locking arm in place. The locking arm 66 keeps the core end 62 positioned on the cams 60 and prevents the upward movement of the core out of the cam fixture 20. The guide plate 76 on the fixture 20 also prevent lateral movement of the core end 62. The cam fixtures 20 work in the same manner for both long core 78 and short core 80 bales.

The rack 10, in the extended position shown in FIGS. 1–3, provides a protective framework for the bales secured in the cam fixtures 20. The stanchions 32 extend above the bale 12 to provide the vertical framework on each corner of the rectangular rack 10. The side support members 18 create a longitudinal framework along the sides. The framework assists in preventing damage to the material while it is stored and transported in the rack 10.

The rack 10 may be transported in both the extended position and the collapsed position by use of a fork lift. A fork lift may be used to move the racks within production facilities and for loading and unloading the racks in a truck trailer. Fork lift brackets 94 are conveniently positioned on the underside of base 14 for acceptance of the forks of a fork lift.

The racks 10 may be stacked up to four high while in the extended position to form a self supporting storage structure. The storage structure is depicted in FIG. 1 with the second interchangeable rack shown in phantom. Each stanchion 32 has a tapered and rounded upper end 96. The expanded footers 28 of the legs 26 are inserted over the upper ends 96 to permit the stacking of the interchangeable racks. The expanded footer 28 in the legs 26 of the second rack engage the stanchions 32 of the first rack as the second rack is lowered down onto the first rack. The vertical framework of the first rack fully supports the second rack to provide a self supporting structure for holding the bales. The stacking of the racks reduces the amount of storage space needed which thereby reduces overall storage costs.

The storage structure additionally permits the transportation of the stacked racks to the end user of the rolled goods. The stacked racks fit into trailers for shipping to the end user. The stacked racks permit the transportation of more material within the limited space of the trailer and thereby reduces overall transportation costs. The racks 10 are off-loaded at the location of the end user and stored until the material is required for final processing.

The present invention permits the dispensing of the rolled goods for final processing directly from the bales 12 mounted in the rack 10. The cam fixtures 20 enable the end user to unwind the material as it is needed for final processing. The removal of the rolled goods is accomplished by positioning the rack 10 at the take-off point for the final process. The end of the material is pulled away from the bale 12 toward the processing line. The cams 60 are responsive to the angular rotation of the bale 12 as the rolled goods are pulled away. The core ends 62 of the bale 12 rotate within the cam fixtures 20 thereby allowing the bale 12 to rotate freely in the direction of the force. The free rotation of the bale 12 within the cam fixtures 20 permits the easy removal of the rolled goods.

The are several means in which the material may be pulled from the bale 12. The material may be pulled manually from the bale and thereafter fed into the final processing line, or it may be pulled automatically by a mechanical unwinding apparatus which feeds the processing line. Alternatively, a direct drive means (not shown) may be connected to one end 62 of the bale core. If the user elects not to dispense the material directly from the rack 10, the bale 12 can be hoisted from the rack 10 and then positioned independently for subsequent production use.

The fork lift brackets 94 on all side of the base 14 facilitate the positioning the rack in the processing area. The lifting brackets 94 permit either front or side entry by the fork lift which may be important in positioning the rack 10.

By allowing the take-off of the rolled goods directly from the storage rack, the present invention eliminates additional handling steps in the production process of the user. The reduction in handling requirements for the bale also prevents damage to the material on the bale. Therefore, the dispensing through the use of the cam fixtures can result in a significant cost savings by reducing handling costs.

Suspending the bale 12 entirely within the rack 10, improves the quality of the rolled goods by eliminating flat spots on the bale. Prior to the present invention, bales were stored on flat pallets which created flat spots in the bale. These flat spots were often sources for quality problems in the final process. Eliminating flats spots in the bale improves the quality of the material and generally increases the operating efficiency in use of the rolled goods.

Figure 4:
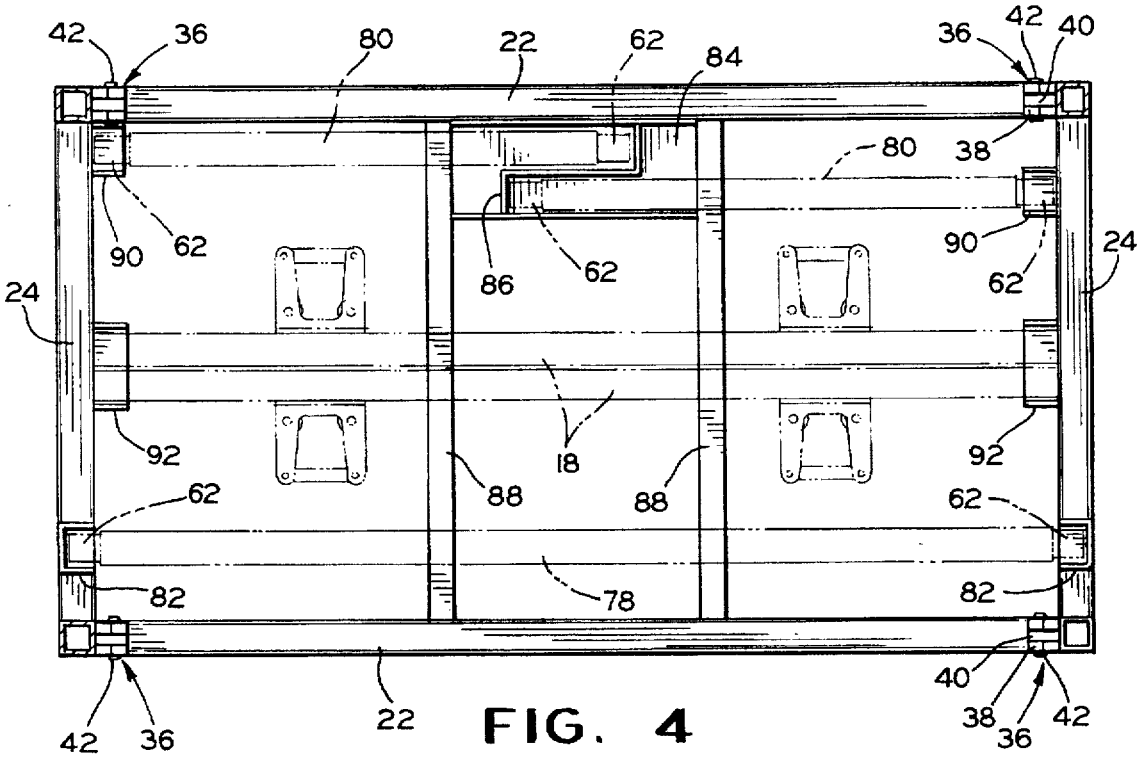
FIG. 4 is a top view of the base with the side support members and the empty cores shown in phantom in their respective holding units while the rack is in the collapsed position.

After all of the material is removed from the bale cores in a rack 10, the rack 10 is removed from the processing area and prepared for shipping back to the rolled goods manufacturer for repeated use. The rack 10 is placed in the collapsed position as shown in FIG. 4.

The rack 10 is collapsed by first removing the empty core 78 or 80 from the cam fixtures 20. The cores 78, 80 are easily removed from the cam fixtures 20 by first removing the pin 72 from the locking arm 66 of each cam fixture 20 and pivoting the locking arm 66 back to free each end 62 of the core. A short core 80 is then manually removed and placed in the base plate 84 and brackets 90 on the base 14. For the longer core 78, the core is placed in the brackets 82 positioned on each end bar 24.

After the cores have been positioned in the appropriate brackets, each side support member 18 is removed from the mounting track 44. The side support members 18 are stored centrally on the base 14 in the brackets 92. The end frames 16 are then pivoted inward and downward adjacent to the base 14.

Figure 7:
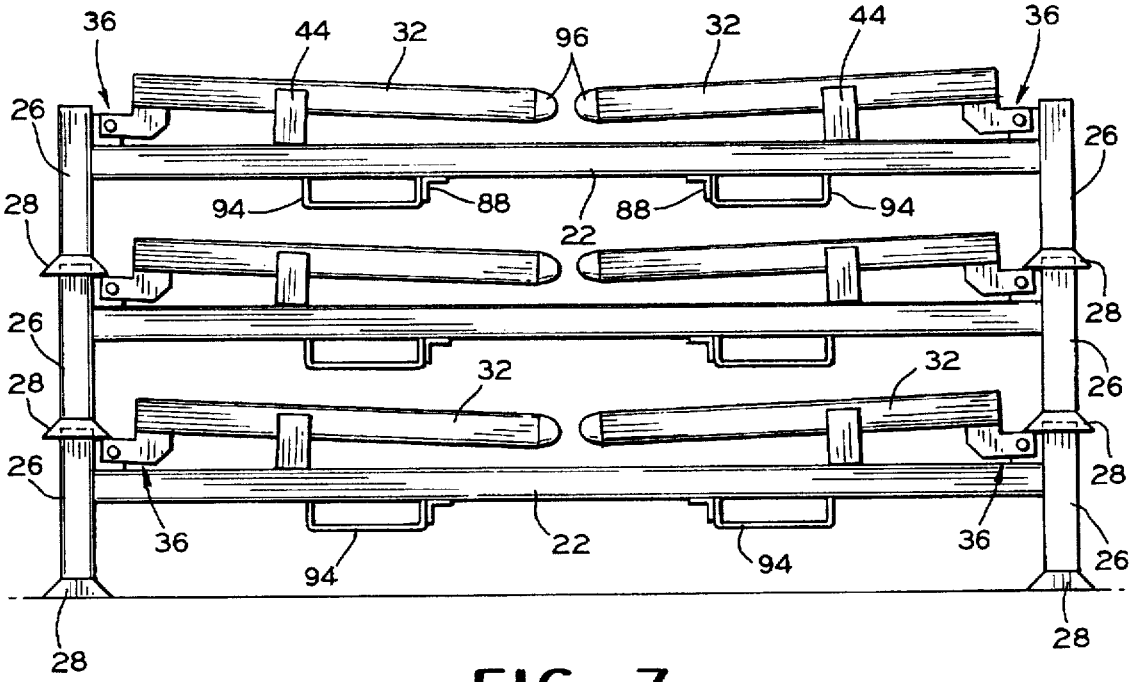
FIG. 7 is an front elevational view of three racks of the present invention in the collapsed positioned stacked on top of each other.

In the present invention, multiple racks 10 may be stacked onto each other in the collapsed position to facilitate shipping of the emptied racks back to the rolled goods manufacturer. The racks 10 are stacked by lowering the one rack 10 over the exposed top sections 30 of the vertical legs 26 of a second rack. The expanded footers 28 on the vertical legs 26 of one rack fit over the top 30 of the vertical legs 26 in another rack to provide a sturdy seated arrangement. Multiple racks may then by seated on top of each other as indicated in FIG. 7. Multiple racks may then be loaded into a trailer and shipped back to the rolled goods manufacturer for repeated use.

In accordance with the provisions of the patent statutes, the present invention has been described in what is considered to represent its preferred embodiment. However, it should be noted that the invention can be practiced otherwise than as specifically illustrated and described without departing from its spirit and scope.

What is claimed is:

1. A collapsible storage rack for storing and dispensing cylindrical bales of rolled goods having cores, said collapsible storage rack comprising:

(a) a generally rectangular base formed by a pair of side bars in parallel, spaced apart relationship and opposing end bars extending therebetween, the end bars defining opposing ends of said base;

(b) a plurality of legs connected to said base for supporting said base in a horizontal position;

(c) an end frame at each of the opposing ends of said base, said end frame having a pair of support stanchions and a lateral cross brace extending between the stanchions, said end frame pivotally mounted on said base such that the end frame moves from an extended position perpendicular to said base to a collapsed position adjacent said base;

(d) side support members removeably mounted onto and extending between the support stanchions on opposing ends of said base when said end frames are in the extended position;

(e) bracket means mounted on said base for storing said side support members adjacent said base when the end frames are in the collapsed position; and (f) at least two cam fixtures for rotatably securing opposing ends of an inner core of a bale of rolled goods, said cams fixtures aligned and mounted onto said side support members such that the bale is suspended in an area defined by said end frames and said side support members to facilitate unwinding of the rolled goods.

2. A collapsible storage rack as recited in claim 1, wherein said base includes core brackets integrally attached to said base for holding, the cores adjacent to said base when said rack is in the collapsed position.

3. A collapsible storage rack as recited in claim 1, wherein a plurality of cam fixtures are aligned on said side support members for holding more than one short core bale in the rack.

4. A collapsible storage rack as recited in claim 1, wherein the cam fixtures further comprise:

(a) a base;

(b) two generally U-shaped side plates positioned in spaced-apart relationship from each other, and extending perpendicularly from said base such that channels formed in said side plates are aligned; and (c) cams positioned between said side plates and on opposing sides of said channel such that a core from a bale extending through said aperture rests on said cams, said cams to facilitate rotation of the core.

5. A collapsible storage rack as recited in claim 4, wherein said cam fixture further comprises, (a) a locking arm having a fixed end pivotally connected to a first end of sad side plates; and (b) a means for securing a free end of said locking arm on a second end of said side plates to secure a core in the channel of said side plates.

6. A collapsible storage rack as recited in claim 4, wherein said cam fixture includes a guide plate extending perpendicular from said base and positioned on an outer edge of said cam fixture adjacent the channel in said side plates.

7. A collapsible storage rack as recited in claim 1 wherein the rigid base includes fork lift frames on all sides of the base for facilitating the lifting and transporting of said rack.

8. A storage structure for storing and dispensing cylindrical bales of rolled goods having cores, comprising:

a plurality of interchangeable collapsible storage racks, each rack having:

(a) a generally rectangular base formed by a pair of side bars in parallel, spaced apart relationship and opposing end bars extending therebetween, the end bars defining opposing ends of said base;

(b) a plurality of legs connected to said base for supporting said base in a horizontal position;

(c) an end frame at each of the opposing ends of said base, said end frame having a pair of support stanchions and a lateral cross brace extending between the stanchions, said end frame pivotally mounted on said base such that the end frame moves from an extended position perpendicular to said base to a collapsed position adjacent said base;

(d) side support members removeably mounted onto and extending between the support stanchions on opposing ends of said base when said end frames are in the extended position;

(e) bracket means mounted on said base for storing said side support members adjacent said base when the end frames are in the collapsed position;

(f) core brackets integrally attached to said base for holding the cores adjacent to said base when said rack is in the collapsed position; and (g) a plurality of cam fixtures for rotatably securing opposing ends of an inner core of one or more bales of rolled goods, said cams fixtures aligned and mounted into said end frames and said side support members such that either one long core bale or one or more short core bales are suspended in an area defined by said end frames and said side support members to facilitate unwinding of the rolled goods, whereby expanded footers of the legs of a first rack engage tapered ends of the stanchions of a second rack to permit stacking of multiple racks in the extended position, and whereby the expanded footer of the legs of the first rack engage the upper end of the leg in the second rack to permit the stacking of multiple racks in the collapsed position.

* * * * *